US010046895B2

(12) United States Patent
Andersen et al.

(10) Patent No.: US 10,046,895 B2
(45) Date of Patent: Aug. 14, 2018

(54) PACKING- AND/OR TRANSPORT UNIT

(71) Applicant: Rockwool International A/S, Hedehusene (DK)

(72) Inventors: Lars Baungaard Andersen, Lille Skensved (DK); Signe Margit Olsen, Roedovre (DK); Christian Johnsen, Kolding (DK)

(73) Assignee: ROCKWOOL INTERNATIONAL A/S, Hedehusene (DK)

( * ) Notice: Subject to any disclaimer, the term of this patent is extended or adjusted under 35 U.S.C. 154(b) by 181 days.

(21) Appl. No.: 15/023,834

(22) PCT Filed: Sep. 16, 2014

(86) PCT No.: PCT/EP2014/069718
§ 371 (c)(1),
(2) Date: Mar. 22, 2016

(87) PCT Pub. No.: WO2015/040024
PCT Pub. Date: Mar. 26, 2015

(65) Prior Publication Data

US 2016/0229610 A1 Aug. 11, 2016

(30) Foreign Application Priority Data

Sep. 23, 2013 (EP) ..... 13185505

(51) Int. Cl.
*B65D 85/62* (2006.01)
*B65D 71/00* (2006.01)
*B65D 85/07* (2017.01)

(52) U.S. Cl.
CPC ..... *B65D 71/0092* (2013.01); *B65D 85/07* (2018.01); *B65D 85/62* (2013.01);
(Continued)

(58) Field of Classification Search
CPC .... B65D 71/0088; B65D 71/10; B65D 85/46; B65D 2571/00061; B65D 2571/00092; B65D 2571/00086; B65D 2571/00012
See application file for complete search history.

(56) References Cited

U.S. PATENT DOCUMENTS 2,801,065 A 7/1957 Moir et al.

FOREIGN PATENT DOCUMENTS

DE 4218354 A1 12/1993
DE 102008004018 A1 8/2008
(Continued)

*Primary Examiner* — Anthony Stashick
*Assistant Examiner* — Mollie Impink
(74) *Attorney, Agent, or Firm* — Harness, Dickey & Pierce, P.L.C.

(57) ABSTRACT

A packing and/or transport unit comprising several insulation elements for flat roof insulation, wherein each insulation element has four side faces being arranged rectangular to each other, a lower surface and an upper surface, the lower and upper surfaces being connected to the side faces and being arranged spaced apart and non-parallel to each other. The insulation elements are arranged in layers in at least one stack on at least one support means being arranged under the stack, which support means comprises at least two carrying feet arranged for resting on a support surface. The stack comprises an uneven number of layers of insulation elements, and the packing and/or transport unit comprises at least one leveling means ensuring that a top plane of the packing and/or transport unit is arranged substantially parallel to the support surface.

18 Claims, 5 Drawing Sheets

(52) U.S. Cl.
CPC ..... *B65D 2571/00018* (2013.01); *B65D 2571/00061* (2013.01); *B65D 2571/00086* (2013.01); *B65D 2571/00092* (2013.01)

(56) References Cited

FOREIGN PATENT DOCUMENTS

| | | | |
|---|---|---|---|
| EP | 0946394 | A1 | 10/1999 |
| WO | WO-2012059192 | A1 | 5/2012 |

14
15
1
7
4
7
4
7
4
2
10
11
3
5
3
11
10

PACKING- AND/OR TRANSPORT UNIT

CROSS-REFERENCE TO RELATED APPLICATIONS

This application is a National Stage of International Application No. PCT/EP2014/069718, filed on Sep. 16, 2014 and claims priority to European Patent Application No. 13185505.8, filed on Sep. 23, 2013. The entire disclosures of the above applications are incorporated herein by reference.

FIELD

The invention relates to a packing and/or transport unit comprising several insulation elements for flat roof insulation, each insulation element having four side faces being arranged rectangular to each other and lower surface and an upper surface, the lower and upper surfaces being connected to the side faces and being arranged spaced apart and non-parallel to each other, whereby the insulation elements are arranged in layers in at least one stack on at least one support means being arranged under the stack, which support means comprises at least two carrying feet arranged for resting on a support surface.

BACKGROUND

This section provides background information related to the present disclosure which is not necessarily prior art.

When the term "flat roof" is used in this specification it is meant to cover roofs that can be horizontal or can be inclined or sloping up to 20°. Often flat roofs are inclined by around 5°.

Packing- and/or transport units are well-known from the prior art. For example DE 10 2008 004 018 A1 discloses a transport unit comprising wedge-shaped roof elements for a sloping roof. In one embodiment the transport unit comprises both ordinary roof elements as well as wedge-shaped elements. DE 10 2008 004 018 A1 describes that the ordinary elements can be arranged above the wedge-shaped elements, so that laying out the roof insulation can be done in an efficient manner.

Furthermore, WO 2012/059192 A1 discloses a packing and/or transport unit comprising several fibrous insulation elements for flat roof insulation being arranged in at least one stack, whereby the stack contains at least two different types of insulation elements, which differ with respect to the material properties. This packing and/or transport unit is easy to handle and allows to arrange most of the materials close to the places where it is to be used. To achieve these advantages the stacked insulation elements comprise lamellae and/or lamella boards having a high compression strength but low point load resistance due to their fiber orientation and at least one insulation board having an even higher compression strength and high point load resistance. This packing and/or transport unit comprises carrying feet made of several insulation board strips arranged on top of each other.

Finally, DE 42 18 354 A1 discloses ways of packaging roof boards in a transport unit using various shapes of carrying feet made of mineral wool. In one embodiment these carrying feet have a trapezoidal cross section. This shape of the carrying feet has the advantage that water for example resulting from rainfall runs of the top surface of the transport unit. Especially in winter it is thereby avoided that freezing water on top of the transport unit damages the foil wrapped around the transport unit. On flat roofs inclined insulations are often installed to direct water from rain and/or snowfall in a certain direction so that the roof can be kept dry most of the time. For this purpose it is well known to use a cut-to-fall roof solution, typically applicable to horizontal concrete decks. Concrete decks are mostly horizontal, so a slope must be provided by the insulation layer. It is well known to arrange one or more layers of plane roof insulation boards and finishing with one or more layers of relatively thin wedge-shaped insulation boards. This solution is time-consuming since many layers must be applied sequentially, and it is therefore also an expensive solution.

Insulation elements are mostly delivered to a roof in a packing and/or transport unit of the type mentioned initially. The number of layers of insulation elements in the packing and/or transport unit depends on the required thickness of insulation which equals the height of the insulation element. It is not desired to have too tall packing and/or transport units, since it is difficult to the workers to pick the insulation elements from such tall packing and/or transport units. Other logistic aspects must also be taken into consideration, in particular the utilization of space on the trucks for transportation. The maximum height of truck spaces is around 2700 mm, and it is desirable to utilize this as much as possible. In practice this means that transport units should be stackable in two layers with a total height of less than around 2700 mm. Thus, each transport unit should be limited to a maximum height to around 1350 mm. Depending on the height of the insulation elements each transport unit can be provided with for example 2, 3, 4 or 5 lamella layers resting on carrying feet.

If there is an even number of layers of insulation elements the transport unit normally has a horizontal upper surface, since it is possible to equal out the sloping surfaces of the stacked insulation elements. However, if the number of layers of insulation elements is uneven the upper surface of the transport unit becomes sloping. Having a sloping top surface of the transport unit is undesirable for various reasons. First of all there is a risk that an upper transport unit will slide on the lower transport unit during transport, when such two transport units are stacked on a truck. Additionally, the upper transport unit should be turned 180° in relation to the lower transport unit in order to equal out the sloping surface of the lower transport unit. This increases the complexity of stacking.

SUMMARY

This section provides a general summary of the disclosure, and is not a comprehensive disclosure of its full scope or all of its features.

It is an object of the invention to avoid the beforementioned drawbacks and to provide a packing- and/or transport unit with an uneven number of layers of inclined insulation elements which can be handled in a conventional way without a risk of sliding or a need of a specific stacking order. In other words it is an object of the invention to "standardize" a transport unit with an otherwise sloping top surface, so that it can be logistically handled like any other transport unit.

A solution is achieved with a packing- and/or a transport unit according to the invention as defined in the claims especially with a packing- and/or transport unit wherein the stack comprises an uneven number of layers of insulation elements and wherein at least one leveling means ensuring that a top plane of the packing and/or transport unit is arranged substantially parallel to the support surface.

According to the invention the packing and/or transport unit can be used for various insulation elements which differ from a prismatic shape in that the two surfaces being connected to the side faces are arranged non-parallel so that these insulation elements can be used to build up a sloping roof on a horizontal concrete or steel deck. In each case independent from the way of arranging the insulation elements in at least one stack the packing and/or transport unit according to the invention can be used to be stacked without the risk of relative movement of the upper packing and/or transport unit relative to the lower packing and/or transport unit. For this purpose at least one leveling means is used which ensures that the top plane of the transport unit is arranged substantially parallel to the support surface on which the packing and/or transport unit is stored. One of the main advantages of the invention is that even if the before-mentioned insulation elements are arranged in stacks to form the packing and/or transport unit it is possible to arrange two or more of these packing and/or transport units in a truck for transportation without the before-mentioned risks. By ensuring that the top plane of the transport unit is substantially parallel to the support surface it is also possible to stack the transport unit according to the invention with other conventional transport unit. The transport unit according to the invention can therefore easily be included in a logistic system comprising conventional transport units. Furthermore, the heights of the packing and/or transport units can be limited so that it is easy for the workers to take out one insulation element after another without using ladders or the like and thereby giving the possibility to use the transport space in a truck for these and possibly others packing and/or transport units in the most efficient way, by stacking two or more of the packing and/or transport units above each other.

It is clear that in the present specification the term "leveling means" is to be understood as means that differs from the insulation elements in the stack—at least in its geometry—otherwise the stack would in practice have an even number of layers and the above-mentioned drawbacks of having an uneven number of layers does not appear. Specific examples of leveling means that differs from the insulation elements are described in the following.

According to a first embodiment of the invention the leveling means comprises at least two carrying feet of different heights, whereby it is possible to keep a horizontal upper surface of the packing and/or transport unit. Preferably, the carrying feet are made of the same material as the insulation elements within the packing and/or transport unit as far as this material has sufficient compression strength for use as carrying feet. For example, if the insulation elements are made of mineral wool the carrying feet can also be made of mineral wool and it is of advantage to use several layers of mineral wool boards so that it is possible to use a different amount of layers for both carrying feet. Of course, the carrying feet can be made of different materials which eventually can be used to produce the flat roof insulation.

According to a second embodiment of the invention the leveling means comprises a strip of pressure resistant material arranged near one end of the stack. The pressure resistant material can be arranged e.g. between two layers of insulation elements or on top of the stack.

According to another embodiment of the invention the leveling means comprises at least one insulation board being arranged in the stack and having different heights at opposite ends. This insulation board can be arranged directly above the carrying feet or within the stack of insulation elements or on top of the stack of insulation elements. Furthermore, it is possible to use more than one insulation board having different heights at opposite ends as leveling means which can be arranged immediately on top of the carrying feet and/or on top of the stack and/or between insulation elements being arranged within the stack. A further embodiment has carrying feet of different heights and at least one insulation board being arranged in the stack and having different heights at opposite ends.

Preferably, the insulation elements, the carrying feet and/or the insulation board are made from mineral wool, for example from glass wool or stone wool. According to another aspect of the invention most of the materials of the packing and/or transport unit can be used in the flat roof insulation so that no waste has to be disposed.

In a preferred embodiment the insulation elements are made of mineral wool and in the shape of so-called lamellae and/or lamella boards having a high compression strength but low point load resistance due to their fibre orientation which—in use—is mainly vertical.

Furthermore, according to another embodiment of the invention at least one insulation board is arranged underneath the stack of the insulation elements and being connected to the carrying feet. The connection of the carrying feet to the insulation board can be done by gluing the carrying feet to the board or by using a foil being wrapped around the insulation board and the carrying feet.

According to a further embodiment of the invention at least one carrying foot comprises a plurality of stacked strips cut from a pressure resistant insulation board, preferably of the same type as the insulation board which might be present in the stack. Using several strips in a stack to form a carrying foot means to use elements which are very variable to build up carrying feet of different heights so that the packing and/or transport unit can be easily adapted to different insulation elements.

To increase the stability of the packing and/or transport unit it is of advantage to arrange at least one insulation board between layers made from insulation elements, especially if more than one stack of insulation elements is arranged within the packing and/or transport unit. In this case the insulation board can cover two or more stacks.

Preferably the insulation boards have a thickness between 15 and 60 mm, preferably between 20 and 40 mm giving the insulation board a sufficient strength to stabilize the packing and/or transport unit.

Especially for this purpose it is of advantage to use an insulation board being equal in length and in width to a layer of the insulation elements as a coverage on the upper surface of the top layer. Such an insulation board protects the insulation elements from damages during the transportation and the handling at the place of use. Furthermore, if this insulation board has different heights in each end it can be used to level the top surface of the top layer to be parallel to the support surface for example in the transport compartment of a truck.

In a preferred embodiment the packing and/or transport unit comprises three up to five insulation elements arranged side by side in each layer of insulation elements. Furthermore, it has been of advantage to use three layers of insulation elements in one stack since it is quite common to use insulation thicknesses of around 300 to 500 mm. In the lower thicknesses there will often be four or five layers of insulation elements in each stack, and in the higher thicknesses there will be only two layers—or even only one layer—of insulation elements in each stack. In most cases there will be provided packing and/or transport units in the middle range with three layers of insulation elements in each stack and the invention is related to such packing and/or transport units with an uneven number of layers of insulation elements.

According to a further embodiment of the invention the layers of insulation elements and the leveling means and the carrying feet are enveloped in a common foil, preferably in the form of a sleeve. The common foil protects the insulation elements on the one hand against humidity and on the other hand in a certain way against damages. Furthermore, the common foil stabilizes the packing and/or transport unit in a very easy way so that it can be handled at the place of production and at the place of use in a very easy way by using conventional lifting appliances.

The invention solves the problem how to achieve a horizontal top plane of a packing and/or transport unit, when an uneven number of layers of insulation elements having a sloping surface are stacked by using a leveling means, such as carrying feet with different heights, including a strip of pressure resistant material in the stack and/or including an insulation board having different heights at opposing ends. Thereby the stacking and transport of such packing and/or transport units on top of each other can be done without any risk of sliding.

The insulation elements may be made of various materials, such as mineral wool, polymeric foam or any other heat insulating material. In a preferred embodiment the insulating material is mineral wool, such as glass wool or stone wool. The insulation element is preferably a so-called lamella which is a certain kind of mineral wool insulation element having a fiber orientation mainly perpendicular to one of its big surfaces which big surfaces are on the one hand the surface which is oriented to the roof and on the other hand the surface which conventionally is oriented parallel to this surface. It should be noted that in the present invention the two surfaces are not parallel with each other, but arranged with a (small) angle, so that a sloping surface of the installed insulation can be provided. Such an orientation of the fibers has the big advantage that the compression strength of a lamella is higher than the compression strength of a mineral wool insulation element having a fiber orientation parallel with the same big surfaces. Lamellas can be produced in several different ways. One very common way is to cut the web of fibers insulation material perpendicular to its longitudinal axis into strips with a width corresponding to the height of the lamellas, which strips are then turned 90°. However, there are also other ways to produce lamellas. Lamella boards are produced by interconnecting at least two of the before mentioned lamellas to one board.

The lamellas and/or lamella boards for the invention may have a density between 30 and 125 kg/m$^3$, preferably between 50 and 90 kg/m$^3$, such as around 60 to 70 kg/m$^3$. These lamellas or lamella boards provide a high compression strength, so that they can be used in flat roofs. However, despite the high compression strength such lamellas and/or lamella boards are relatively weak in resisting point loads as when roofers walk on the roof. Therefore, they often require pressure resistant boards having higher point load resistance to be arranged on top of the lamellas and/or lamella boards. On the other hand lamellas and/or lamella boards with such densities are easy to handle and are sufficiently stable to withstand damages. The density of the insulation board is at least 70 kg/m$^3$, often at least 120 to 150 kg/m$^3$, and the thickness is often between 15 and 60 mm, preferably between 20 and 40 mm.

In particular each lamella and/or lamella board has an area which corresponds to an integer fraction of the area of the insulation board. According to this feature the insulation board has an area which is equal to the area which can be built-up by using two or more lamellas and/or lamella boards. Especially each insulation board being used in the packing and/or transport unit has an area which is equal to the area of four or five lamellas. It is preferred that the total area of the insulation boards in a packing and/or transport unit corresponds to the total area of the insulation elements in the same packing and/or transport unit.

In a preferred embodiment each carrying foot, comprises at least one, preferably two up to five stacked strips cut from insulation boards. The carrying foot is thereby made from insulation material and can therefore be used in the roof insulation. Furthermore, on top of the carrying feet at least one, preferably two insulation boards having a bigger area are arranged. These insulation boards can also be used in roof insulation, for example as point load resistant top plates arranged on top of the lamellas, and the use of more than one insulation boards directly above the support means gives the whole packing- and/or transport unit a high stability so that this packing- and/or transport unit can be handled with machines as they are usually present on building sites.

DRAWINGS

The drawings described herein are for illustrative purposes only of selected embodiments and not all possible implementations, and are not intended to limit the scope of the present disclosure.

Embodiments of the packing- and/or transport unit according to the invention are described in the following with reference to the drawing in which FIG. 1 shows a packing- and/or transport unit in a first embodiment in a side view;

DETAILED DESCRIPTION

Example embodiments will now be described more fully with reference to the accompanying drawings.

Figure 1:
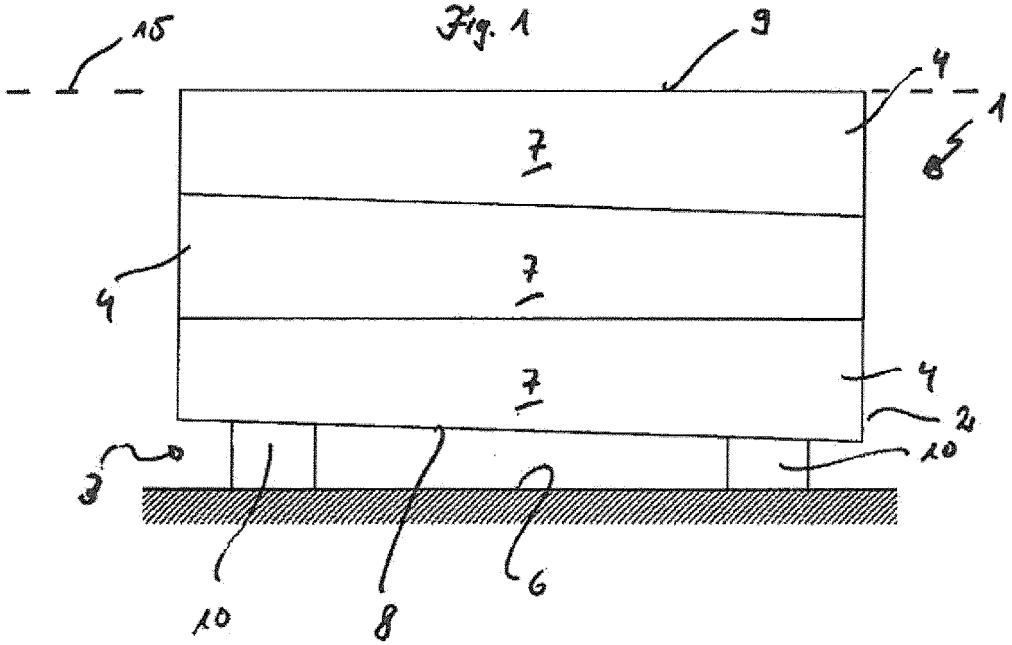

FIG. 1 shows a first embodiment of a packing- and/or transport unit 1 comprising three layers of insulation elements 4 for flat roof insulation being arranged in one stack 2. The stack 2 is arranged on support means 3 being arranged under the stack 2 for resting on a support surface 6. In a preferred embodiment the stack 2 contains mineral wool lamellas as insulation elements 4, having a high compression strength and low point load resistance due to their mineral fiber orientation.

Each insulation element 4 has four side faces of which one side face 7 is visible in FIG. 1 and a lower surface 8 and an upper surface 9 being connected to the side faces 7 which are arranged rectangular to each other. The lower surface 8 and the upper surface 9 are arranged spaced apart and non-parallel to each other, whereby the insulation elements 4 are arranged in layers forming the stack 2.

The support means 3 comprise two carrying feet 10. The carrying feet 10 have different heights and provide therefore a leveling means ensuring that the top plane 15 (indicated by a dotted line) of the transport unit 1, which in this embodiment corresponds to the upper surface 9 of the top layer of the insulation elements 4, is arranged parallel to the support surface 6.

From FIG. 1 it can be seen that the upper and the lower insulation element 4 of the stack 2 are directed in the same direction so that the ends of the insulation elements 4 having the bigger height are arranged at one side of the packing and/or transport unit whereas the middle layer of the insulation elements 4 is arranged in opposite direction so that the end with the bigger height of the middle layer of the insulation elements 4 is arranged at the side of the stack 2 where the ends of insulation elements 4 of the upper and lower layer with the smaller heights are arranged. Since the number of layers of insulation elements in the stack 2 is uneven (three layers in this embodiment) the upper and lower surfaces of the stack 2 are not parallel.

Nevertheless, by using the leveling means in form of the carrying feet 10 of different heights the upper surface 9 of the stack 2 (and thereby the top plane 15 of the packing and/or transport unit 1) is arranged parallel to the support surface 6 so that a further stack 2 can be arranged on the upper surface 9 as it is shown in e.g. FIG. 6 which will be described later on.

As already mentioned the insulation elements 4 are preferably lamellae made from mineral fibres which are bound with an organic binder. In the same way the carrying feet 10 are preferably made from mineral fibres bound with an organic binder so that the carrying feet 10 can be used for the insulation of the flat roof.

Figure 2:
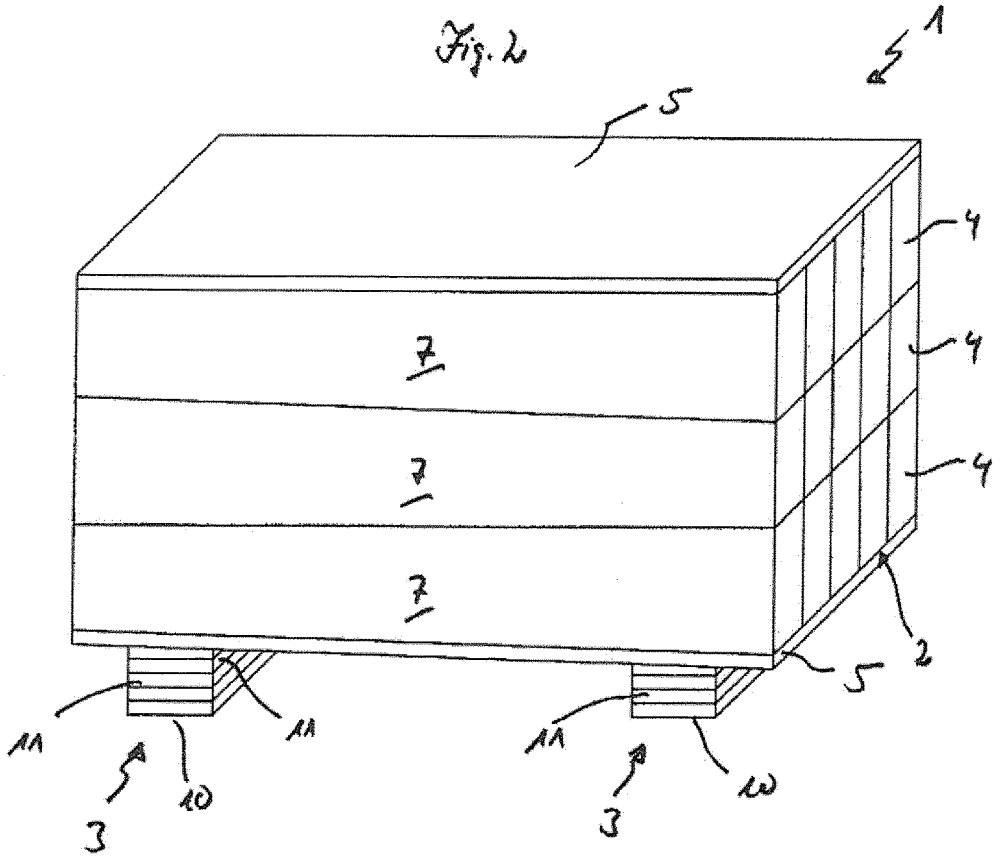
FIG. 2 shows a transport unit in a second embodiment in a perspective view.

FIG. 2 shows a second embodiment of a packing and/or transport unit 1 in a perspective view. It can be seen from FIG. 2 that the insulation elements 4 are again arranged in three layers with five insulation elements 4 side by side in each layer on an insulation board 5 being arranged on the carrying feet 10 being spaced apart to each other and running perpendicular to the lengthwise direction of the insulation elements 4.

Furthermore, a second insulation board 5 is arranged as a covering on top of the uppermost layer of insulation elements. The size of both insulation boards 5 on top of the carrying feet 10 and on top of the top layers of the insulation elements 4 is equal to the length and the width of the insulation elements 4 in each layer, so that both insulation boards 5 cover the whole upper surface and the whole lower surface of the stack 2.

Both insulation boards 5 stabilize the packing and/or transport unit 1 and protect the upper and lower surfaces of the insulation elements 4 against damages. Additionally, the insulation boards 5 are applicable as a point load pressure resistant layer on top of the insulation elements 4, when they have been applied to the roof.

Furthermore, it can be seen from FIG. 2 that each carrying feet 10 consists of several stacked strips 11, which are preferably cut from an insulation board 5. The left carrying feet 10 consists of five insulation board strips 11 whereas the right carrying feet 10 consists of four insulation board strips 11. The insulation board strips 11 are preferably made from mineral fibres bound with an organic binder and which may have the same thickness as the insulation boards 5 so that the insulation strips 11 can be used together with the insulation boards 5 in the roof insulation.

The insulation boards 5 have an even higher compression strength and a higher point load resistance than the insulation elements 4 so that they can be used as a pressure resistant top layer in a flat roof insulation.

Figure 3:
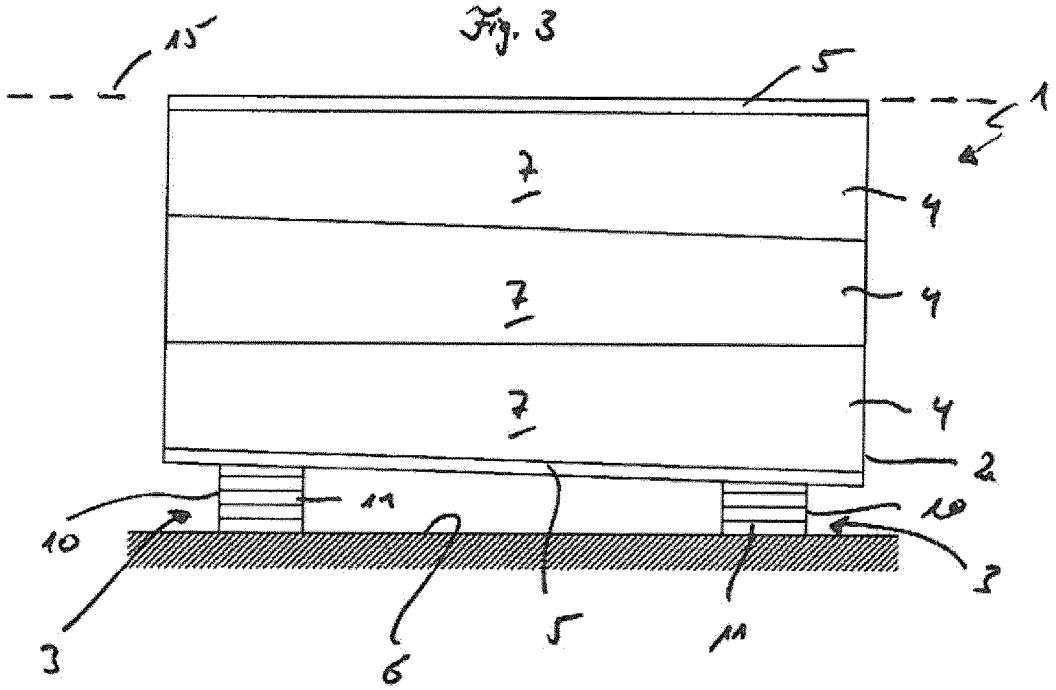
FIG. 3 shows the transport unit according to the FIG. 2 in a side view.

FIG. 3 shows the packing and/or transport unit 1 according to FIG. 2 in a side view.

Figure 6:
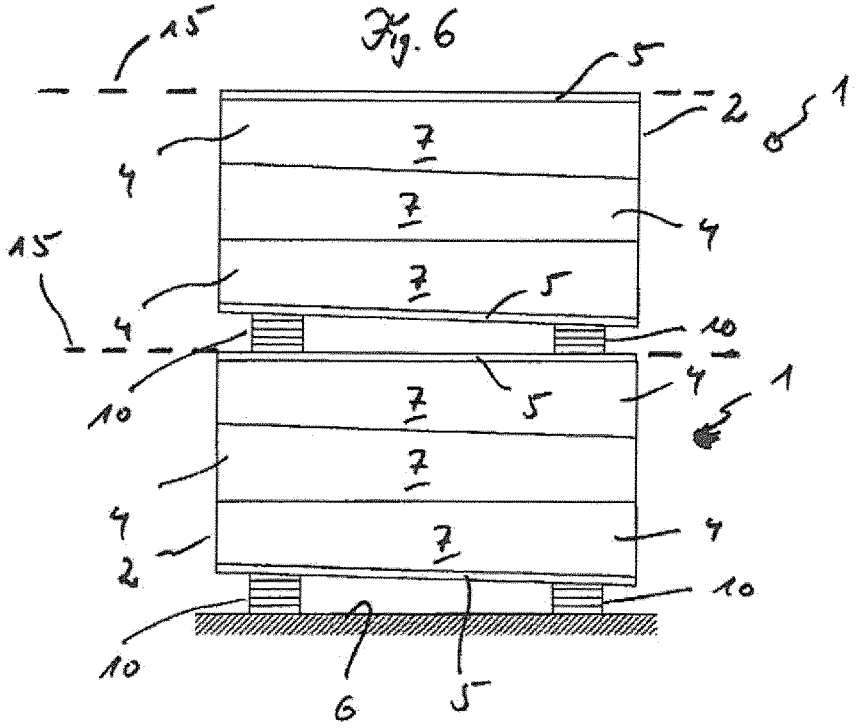
FIG. 6 shows two packing- and/or transport units stacked above each other in a side view.

FIG. 6 shows two of the before-described packing and/or transport units 1 according to FIG. 2 arranged on top of each other, and it can be seen that due to the different heights of the carrying feet 10 the top plane 15 (corresponding to the top surface) of the packing and/or transport units are parallel with the support surface 6, so that stable stacking is ensured.

Figure 4:
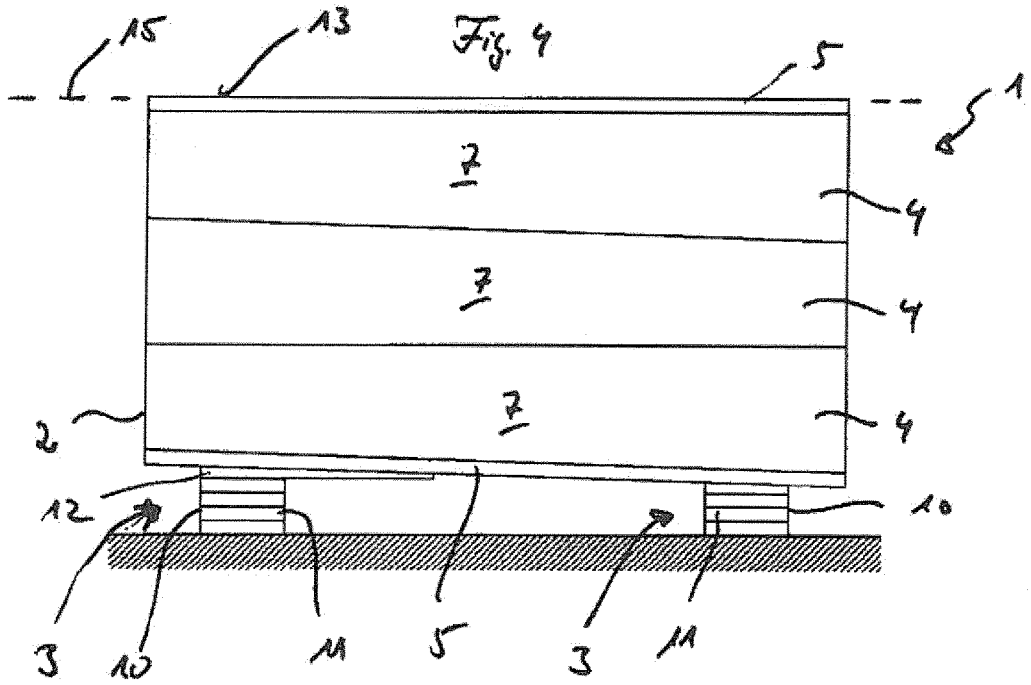
FIG. 4 shows a third embodiment of a packing- and/or transport unit in a side view.

A further embodiment of a packing and/or transport unit 1 can be seen from FIG. 4. This packing and/or transport unit 1 according to FIG. 4 differs from the embodiment according to the before-described FIGS. 1 to 3 in that both carrying feet 10 have the same height and that there is provided one insulation board 12 having different heights at opposite ends so that this insulation board 12 has a cross-section in form of approximately a triangle or a wedge. This insulation board 12 is used as the leveling means ensuring that the top plane 15 (corresponding to the upper surface 13 of the insulation board 5 being arranged on the top surface of the stack 2) is arranged parallel to the support surface 6.

As can be seen from FIG. 4 the length of the insulation board 12 is shorter than the length of the insulation board 5 being arranged on top of the right carrying foot 10 and on the insulation board 12 being arranged on top of the left carrying foot 10.

The insulation board 12 is made from mineral fibres bound with an organic binder. It can be used for the flat roof insulation.

Figure 5:
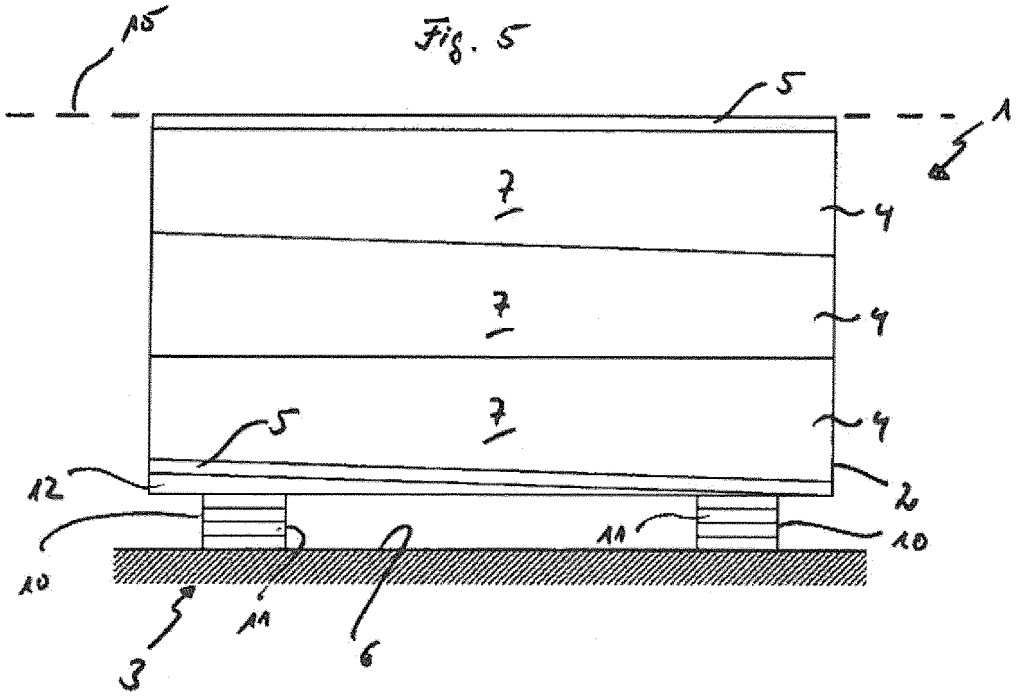
FIG. 5 shows a fourth embodiment of a packing- and/or transport unit in a side view.

FIG. 5 shows a further embodiment of the packing and/or transport unit 1 which is very similar to the embodiment according to FIG. 4 and which differs from the embodiment of FIG. 4 in that the insulation board 12 has the same length as the insulation board 5 covering the lower surfaces of the insulation elements 4 being arranged as lowest layer of the stack 2. Instead of being arranged underneath the stack 2 the insulation board 12 could also be arranged between two layers of the insulation elements 4.

Figure 7:
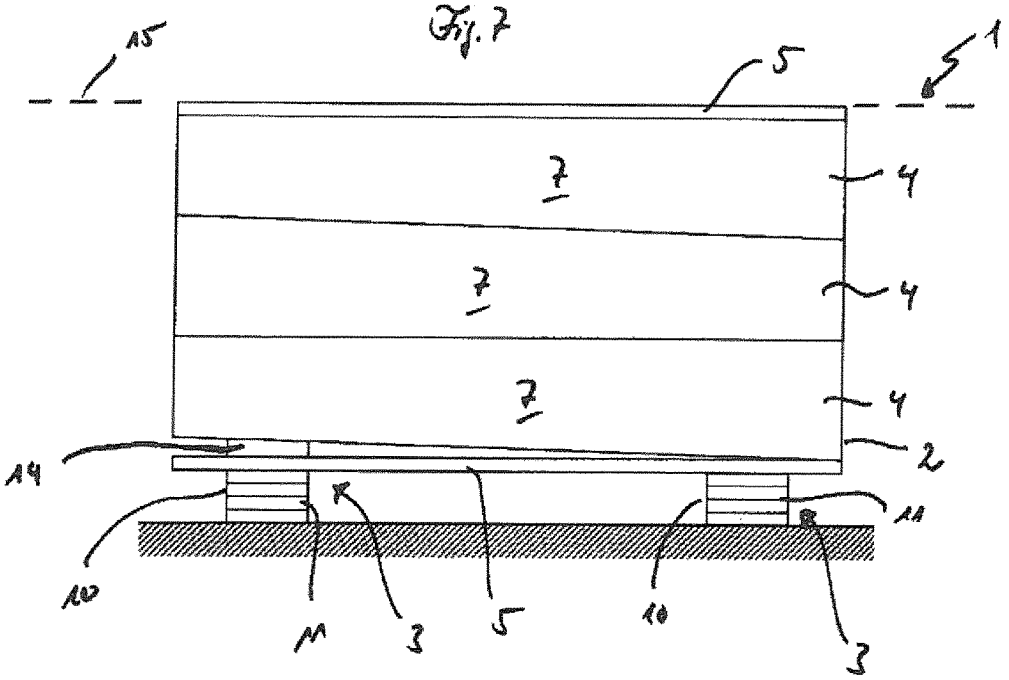
FIG. 7 shows a fifth embodiment of a packing- and/or transport unit in a side view.
Figure 8:
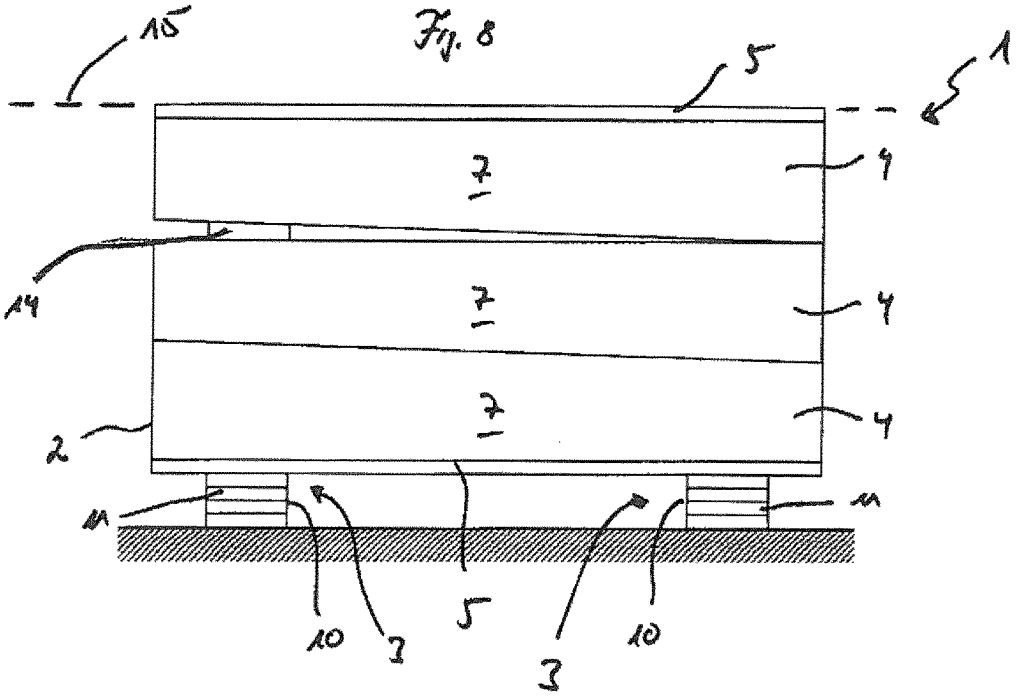
FIG. 8 shows a sixth embodiment of a packing- and/or transport unit a side view and FIG. 9 shows a seventh embodiment of a packing- and/or transport unit a side view.
Figure 9:
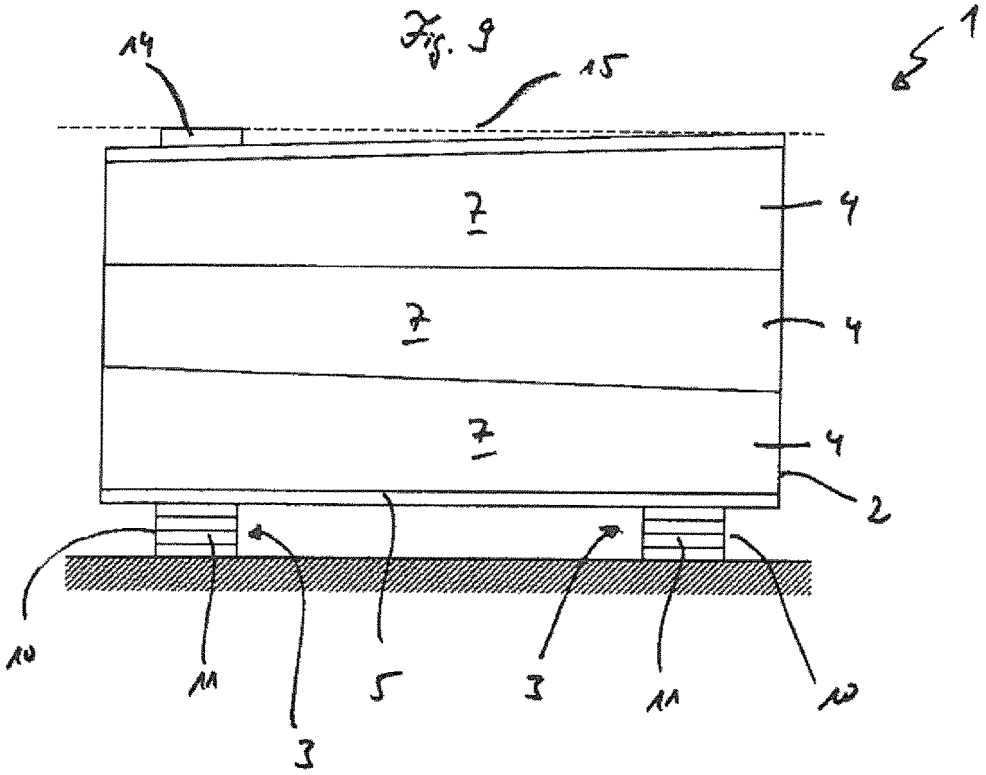

FIGS. 7 to 9 show further embodiments of a packing and/or transport unit according to the invention. In these embodiments the leveling means comprises a strip 14 of pressure resistant material arranged somewhere in or on the stack 2 near to one end thereof. The strip 14 for the leveling means may be identical with the strips 11 used for the carrying feet 10 or it may be different in relation to material and dimensions. In FIG. 7 the strip 14 is arranged directly on top of a lower insulation board 5. In FIG. 8 the strip 14 is arranged between the second and third layers of insulation elements 4, and in FIG. 9 the strip 14 is arrange on top of the stack 2 of insulation elements 4. In FIGS. 7 and 8 the top plane 15 of the packing- and/or transport unit 1 corresponds to the upper surface of the stack 2. In FIG. 9 the top plane 15 is indicated by a dotted line that indicates an imaginary top surface of the packing- and/or transport unit 1 that allows stable stacking of two packing- and/or transport units 1.

It is preferred that the whole packing and/or transport unit 1 is enveloped in a foil which protects the insulation elements 4, the insulation boards 5 as well as the support means 3 against water ingress and damages. The foil, which is not shown in the figures, surrounds the whole stack 2 and the support means 3.

As mentioned the insulation elements and the insulation boards 5 as well as the carrying feet 10 can be made from any insulating material, but are preferably made from mineral fibers, preferably from stone wool which mineral fibers are bound with artificial resin.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. Packing and/or transport unit comprising several insulation elements for flat roof insulation, each insulation element having four side faces being arranged with adjacent side faces at right angles to each other, a lower surface and an upper surface, the lower and upper surfaces being connected to the side faces and being arranged spaced apart and non-parallel to each other, whereby the insulation elements are arranged in layers in at least one stack on at least one support means being arranged under the stack, which support means comprises at least two carrying feet arranged for resting on a support surface, wherein the stack comprises an uneven number of layers of insulation elements, and that the packing and/or transport unit comprises at least one leveling means ensuring that a top plane of the packing and/or transport unit is arranged substantially parallel to the support surface.

2. Packing and/or transport unit according to claim 1, wherein the leveling means comprises the at least two carrying feet each having different heights.

3. Packing and/or transport unit according to claim 1, wherein the leveling means comprises a strip of pressure resistant material.

4. Packing and/or transport unit according to claim 3, wherein the strip of pressure resistant material is arranged between two layers of insulation elements in the stack.

5. Packing and/or transport unit according to claim 3, wherein the strip of pressure resistant material is arranged on top of the stack.

6. Packing and/or transport unit according to claim 1, wherein the leveling means comprises at least one insulation board being arranged in the stack and having different heights at opposite ends.

7. Packing and/or transport unit according to claim 1, wherein the insulation elements and/or the carrying feet are made from mineral fibres.

8. Packing and/or transport unit according to claim 7, wherein the stacked insulation elements comprise lamellas and/or lamella boards having a density between 30 and 125 $kg/m^3$.

9. Packing and/or transport unit according to claim 1, wherein at least one cover board is arranged underneath the stack of the insulation elements and is connected to the carrying feet.

10. Packing and/or transport unit according to claim 1, wherein at least one carrying foot comprises a plurality of stacked insulation strips.

11. Packing and/or transport unit according to claim 1, wherein the leveling means comprises at least one insulation board arranged between layers of insulation elements.

12. Packing and/or transport unit according to claim 1, wherein the leveling means comprises at least one insulation board having a thickness between 15 and 60 mm.

13. Packing and/or transport unit according to claim 1, wherein a cover board being equal in length and width to a layer of insulation elements is arranged as a coverage on the upper surface of the top layer.

14. Packing and/or transport unit according to claim 1, wherein each layer in the stack includes at least three insulation elements arranged side by side.

15. Packing and/or transport unit according to claim 1, wherein the layers of insulation elements and the leveling means and the carrying feet are enveloped in a foil.

16. Packing and/or transport unit according to claim 7, wherein the insulation elements, the carrying feet, and/or the leveling means are made from glass wool or stone wool.

17. Packing and/or transport unit according to claim 12, wherein the insulation boards have a thickness between 20 and 40 mm.

18. Packing and/or transport unit according to claim 15, wherein the carrying feet are enveloped in a foil in the form of a sleeve.

* * * * *